US006393786B1

(12) United States Patent
Hudson et al.

(10) Patent No.: US 6,393,786 B1
(45) Date of Patent: May 28, 2002

(54) FIRE-RESISTANT BLOCK

(75) Inventors: Colin J. Hudson, Worcester; Michael Scott Rae, Mildenhall, both of (GB)

(73) Assignee: Pittsburgh Corning Corporation, Pittsburgh, PA (US)

( * ) Notice: Subject to any disclaimer, the term of this patent is extended or adjusted under 35 U.S.C. 154(b) by 0 days.

(21) Appl. No.: 09/575,020

(22) Filed: May 19, 2000

(51) Int. Cl.[7] ..... E04C 1/42
(52) U.S. Cl. ..... 52/306; 52/309.3; 52/171.3
(58) Field of Search ..... 52/306, 309.3, 52/309.5, 171.3; 427/230, 231, 407.2

(56) References Cited

U.S. PATENT DOCUMENTS 5,595,032 A * 1/1997 Richards et al. ..... 52/306
5,928,724 A * 7/1999 Descamps et al. ..... 52/306

* cited by examiner

*Primary Examiner*—Carl D. Friedman
*Assistant Examiner*—Naoko Slack
(74) *Attorney, Agent, or Firm*—Reed Smith LLP

(57) ABSTRACT

A fire-resistant block containing a fire-resistant gel covering one or more interior faces of the block. The gel expands towards the interior of the block when exposed to increased temperatures. This block is lighter, less expensive, and more fire-resistant. A plurality of these blocks may be combined to form a fire-resistant wall or partition.

8 Claims, 1 Drawing Sheet

FIRE-RESISTANT BLOCK

FIELD OF THE INVENTION

The present invention generally relates to improved building blocks. More particularly, the invention relates to glass blocks containing a fire-resistant gel-like substance incorporated in such a manner as to improve the aesthetics and functionality of the blocks relative to the prior art.

BACKGROUND OF THE INVENTION

Glass blocks may be used instead of bricks, plaster, wood or other materials in the construction of walls and partitions. Aside from the aesthetic advantages that the glass blocks may provide over other materials, the glass blocks may be preferable because they are transparent and allow light to filter through, thereby permitting viewing through the wall, or creating a brighter room or office space.

U.S. Pat. No. 5,595,032 (incorporated herein by reference) teaches that such glass blocks may also provide improved fire resistance if the blocks are filled with certain fire-resistant gels, such as the elastomeric or gel-like product of a cured polydiorganosiloxane composition. However, the prior art is subject to several shortcomings solved by the present invention.

One disadvantage results from the prior art blocks being positioned vertically as they are filled with the fire-resistant gel. Because the gel expands when heated, the block should not be completely filled in order to maintain room for expansion of the gel within the block. If the block were completely filled, then expansion of the gel in the presence of wanner temperatures would likely cause the block to crack. The presence of this expansion area, however, leads to the undesirable result of having a line visible through the glass where the gel stops. Also, the fact that the interior faces of the block are not entirely covered with gel makes the block less effective as a fire resistor because it will take time for the faces to become covered via expansion of the gel in the presence of fire.

With the prior art blocks it also is necessary to take into account solar and other heat buildups that may expand the gel to levels that would crack the block or to levels that would not allow for sufficient expansion in the presence of fire. For this reason it is usually recommended that the blocks not be used on external walls because of the effect that direct sunlight may have on the gel.

Another disadvantage results from the need for the prior art blocks to be filled, shipped and/or installed upright and vertical. If they are tilted, or laid flat, the gel tends to peel away from the interior face of the block, leaving air bubbles or other unattractive appearances within the block.

Another disadvantage is that glass building blocks are generally large and therefore require a large quantity of gel to fill them nearly to the top. Due to reactions between this large quantity of gel and the glass, it is necessary to prime the internal surfaces of the blocks prior to insertion of the gel in order to prevent the formation of bubbles. These features not only result in an unnecessarily heavy block, but also increase its production cost.

It would be desirable, therefore, to develop a fire-resistant glass block and method for making the same that do not present the disadvantages and shortcomings discussed above.

SUMMARY OF THE INVENTION

The present invention improves upon the prior art in several ways. First, it seeks to eliminate the unsightly gel fill line by providing virtually 100% coverage of one or more of the block's interior faces. A thickness of gel as little as five millimeters on one face has been shown to provide over thirty minutes of insulation under the British Standard 476. Therefore, the amount of gel necessary to fill the block is substantially reduced, as is the weight of the block. Furthermore, with the interior face entirely covered, the block becomes more efficient as a fire resistor because there is no time delay between the onset of fire conditions and a state of complete face coverage, as there is with the prior art blocks.

Also, the present invention may be used externally (i.e., outdoors or in partitions or walls facing outdoors) without concern about expansion of the gel from solar and other heat buildups because the gel is injected in such a way as to allow for greater expansion without damage to the glass block. Specifically, the gel is injected so that it coats one or both interior faces, thereby creating a large space for lateral expansion towards the interior of the block. It is therefore not a requirement to calculate the precise quantity of gel that can go into each block before solar expansion damage becomes a possibility.

Also, the present invention may be handled and installed in any orientation. In one preferred embodiment, the gel itself has adhesive properties that hold it to the internal faces. In another preferred embodiment, a separate adhesive may be applied to the internal surface of each face that will be coated with the gel. In either case, the gel then sticks to the face regardless of the block's orientation.

DETAILED DESCRIPTION OF THE DRAWINGS

Figure 1:
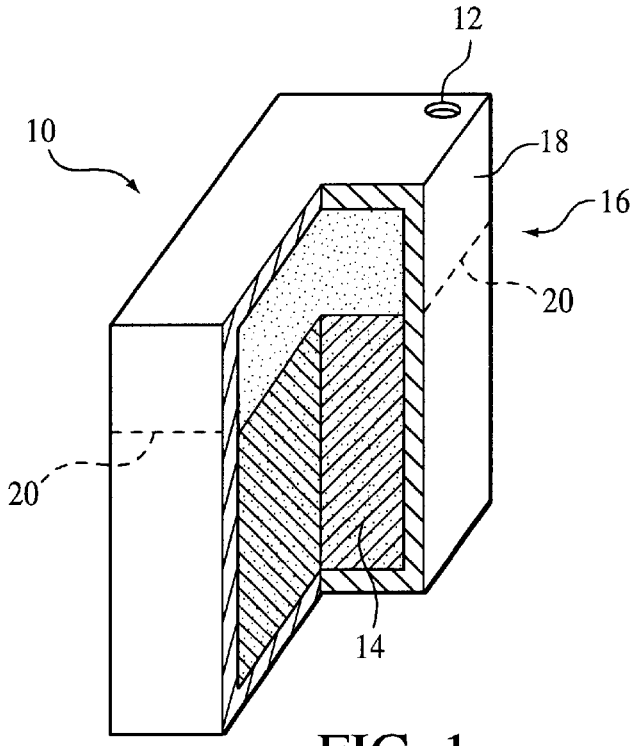
FIG. 1 PRIOR ART
FIG. 1 shows the cross section of a prior art glass block filled with a fire-resistant gel.

FIG. 1 shows a typical prior art glass block 10 with a hole 12 in its top surface through which a fire-resistant gel 14 is injected or poured until it reaches a position 16. The glass block 10 must be filled as it is sitting upright. Although the glass block 10 is most effective as a fire resistor if its front and back surfaces are completely covered with gel 14, an air space 18 must remain inside the glass block 10 to allow for expansion of the gel 14 in the presence of increased temperatures. If the gel 14 filled the glass block 10 entirely, then an increase in temperature would cause the block to crack due to expansion of the gel 14. Because the gel 14 is filled only to position 16, and because the glass block 10 is transparent, a line 20, marking the fill line of the gel 14 is visible through the face of the glass block 10 at position 16. Therefore, not only does the partial filling of the glass block 10 result in decreased effectiveness of the glass block 10 as a fire resistor, but it also results in the presence of a visible fill line 20, which decreases the aesthetic appeal of the glass block 10.

Figure 2:
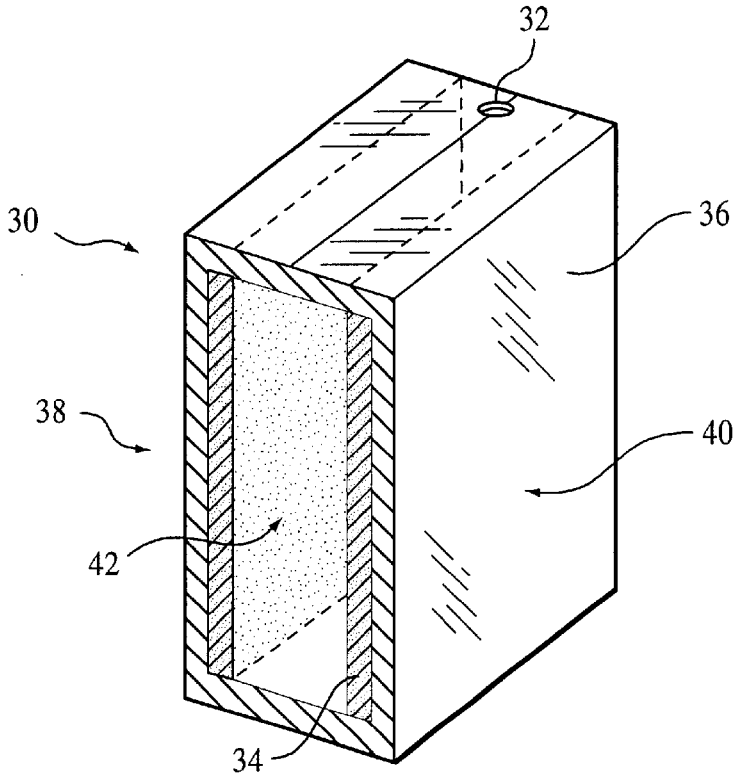
FIG. 2 shows the cross section of a preferred embodiment of the present invention, namely a glass block having one or more faces entirely coated with a fire-resistant gel.

FIG. 2 shows a preferred embodiment of the present invention, which seeks to overcome the shortcomings and disadvantages of the prior art. In FIG. 2, a glass block 30 (shown in cross-section) has a hole 32 through which a fire-resistant gel 34 is injected or poured. First, the glass block 30 is laid on one face 36, and the gel 34 is injected or poured through the hole 32 until it covers substantially the entire interior face 36 to provide the appropriate thickness for the desired fire-resistance. Then after the gel cures the glass block 30 is turned over on its opposite face 38, and additional gel 34 is injected or poured through the hole 32 until it covers the entire interior face 38, again reaching the appropriate thickness for the desired fire-resistance. The thickness of the gel 34 is generally four to five millimeters, but may be increased if a greater level of fire-resistance is desired or decreased as more efficient gels are created. Depending on the nature of the block's use and the desired level of fire-resistance, it may be necessary to coat only one interior face 36 or 38 of the glass block 30. Whether one or both interior faces are coated, expansion space for the gel exists within the interior of the glass block 30.

In one preferred embodiment, the gel 34, if not inherently adhesive, may be made to stick better to the inside of the glass block 30 by priming the interior faces with a separate adhesive 40 during production of the glass block 30.

Alternatively, the glass block 30 may be manufactured without a fill hole 32 by applying the gel 34 to the interior face or faces of two block halves, then joining the two halves together with an adhesive.

The advantages of this invention are several. With one or more interior faces entirely covered with the gel 34, the glass block 30 becomes a more effective and efficient fire resistor than it would be with only partial interior face coverage. With partial interior face coverage, it takes time for the gel 34 to expand to cover an entire face and provide the desired fire protection. Furthermore, with one or more interior faces entirely covered with the gel 34, there is no unsightly fill line of the gel 34. Another advantage is the presence of the expansion space 42, into which the gel 34 can expand away from the interior faces 36 and 38. With such an area for expansion, the glass block 30 may be used outdoors without the fear of damage to the glass block 30 caused by solar heating. Elimination of this fear also means that it is not a fundamental requirement to precisely calculate the maximum volume of gel 34 that can fit inside the glass block 30 before expansion from solar heating threatens to crack the glass block. The fact that the gel 34 sticks to the faces 36 and 38 means that there will be no peeling (or a reduced chance of peeling) of the gel 34 regardless of the orientation of the glass block's handling and installation. Finally, reducing the amount of gel 34 in the glass block 30 as compared to the prior art reduces both the cost and the weight of the completed glass block 30 (ie., less gel).

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A glass block, having one or more faces and a top and a bottom sidewall, containing a fire-resistant gel, said gel coating the interior of at least one of the faces without substantially coating a top and a bottom sidewall.

2. The glass block of claim 1 wherein an adhesive is applied to the interior face of the block.

3. A wall comprising a plurality of glass blocks, wherein two or more of the blocks contain a fire-resistant gel, said gel coating one or more interior faces of the blocks without substantially coating a top and a bottom sidewall of the blocks.

4. A method of making a fire-resistant glass block comprising the step of coating an interior face of the block with a fire-resistant gel without substantially coating the top and the bottom sidewall of the block.

5. The method of claim 3 comprising the additional steps of:

allowing the gel to cure; and coating the interior of the opposite face with the gel.

6. The method of claim 4, comprising the additional step of:

applying an adhesive to one or both interior faces of the block prior to coating with the gel.

7. A method of making a fire-resistant glass block comprising the steps of:

applying an adhesive to an interior face of a glass block; and coating substantially all of the said interior face of the block with a fire-resistant gel.

8. A method for improving the fire-resistance of a glass block comprising the step of coating an interior face of the glass block with a fire-resistant gel without substantially coating a top and a bottom sidewall of the block.

* * * * *